US008016627B2

(12) United States Patent
Andrea et al.

(10) Patent No.: US 8,016,627 B2
(45) Date of Patent: Sep. 13, 2011

(54) PERSONAL WATER SAFETY DEVICE

(75) Inventors: John N. Andrea, Lloyd Harbor, NY (US); Gregory Lyon, Mamaroneck, NY (US)

(73) Assignee: West Neck Partners, Inc., Lloyd Harbor, NY (US)

( * ) Notice: Subject to any disclaimer, the term of this patent is extended or adjusted under 35 U.S.C. 154(b) by 152 days.

(21) Appl. No.: 12/273,184

(22) Filed: Nov. 18, 2008

(65) Prior Publication Data

US 2009/0130933 A1 May 21, 2009

Related U.S. Application Data

(60) Provisional application No. 61/003,637, filed on Nov. 19, 2007.

(51) Int. Cl.
*B63C 9/08* (2006.01)

(52) U.S. Cl. ..... 441/122

(58) Field of Classification Search ..... 441/80, 441/88, 90–94, 96, 122, 129; 405/185, 186
See application file for complete search history.

(56) References Cited

U.S. PATENT DOCUMENTS

| | | | | |
|---|---|---|---|---|
| 1,230,290 | A | | 6/1917 | Geiger |
| 1,488,049 | A | | 3/1923 | Lawless |
| 2,675,143 | A | | 1/1951 | Seemann, Jr. |
| 2,979,740 | A | | 8/1957 | Walker et al. |
| 2,937,387 | A | | 11/1957 | Boynton, Jr. |
| 3,046,575 | A | | 10/1959 | Davis et al. |
| 3,070,818 | A | | 1/1963 | Fairchild |
| 3,144,667 | A | | 8/1964 | Dobbs |
| 3,173,162 | A | * | 3/1965 | Elder, Jr. ..... 441/94 |
| 3,510,895 | A | | 5/1970 | Wynne |
| 3,890,662 | A | | 6/1975 | Roberts |
| 4,184,216 | A | | 1/1980 | Saleen |
| 4,629,436 | A | | 12/1986 | Stewart et al. |
| 4,662,850 | A | | 5/1987 | Bostic, Sr. |
| 4,810,219 | A | * | 3/1989 | Anderson et al. ..... 441/80 |
| 4,813,899 | A | | 3/1989 | Fujimoto |
| 4,968,277 | A | | 11/1990 | Parish et al. |
| 5,022,879 | A | | 6/1991 | DiForte |
| 5,178,569 | A | | 1/1993 | Wang |
| 5,374,212 | A | | 12/1994 | Lall |
| 5,421,760 | A | | 6/1995 | Blaga |
| 5,456,623 | A | * | 10/1995 | Norris ..... 441/92 |
| 5,518,430 | A | | 5/1996 | Crowder et al. |
| 5,669,795 | A | | 9/1997 | Lahtinen |
| 5,702,279 | A | | 12/1997 | Brown |
| 5,816,878 | A | | 10/1998 | McNamee |
| 5,823,840 | A | | 10/1998 | Powers |
| 5,879,213 | A | | 3/1999 | Williams, Jr. et al. |

(Continued)

*Primary Examiner* — Daniel V Venne
(74) *Attorney, Agent, or Firm* — Carter, DeLuca, Farrell & Schmidt, LLP

(57) ABSTRACT

A personal water safety device includes a strap and a housing attached to the strap. The strap includes a cinch and a fastening device. The housing includes an inflatable bladder, an inflation assembly disposed within the inflatable bladder, and an actuator. The actuator includes a lanyard and a ring. The inflation assembly includes a frame and a gas container. The frame includes a retaining clip to prevent the gas container and a portion of the inflatable bladder from prematurely dislodging. The gas container deploys gas to the inflatable bladder for inflation. The inflatable bladder remains attached in a substantially stationary position adjacent to the upper arm of the user by the strap. The inflatable bladder can be disposed in a substantially cylindrical shape. The inflatable bladder can be formed from a highly visible material. A second strap can be attached to the inflatable bladder for stability.

20 Claims, 10 Drawing Sheets

U.S. PATENT DOCUMENTS 6,004,178 A 12/1999 Liu et al.
6,089,403 A 7/2000 Mackal
6,260,570 B1 7/2001 Wass et al.
6,409,561 B1 6/2002 Ibasfalean
6,422,420 B1 7/2002 Brown
6,805,599 B1 10/2004 Huang
6,951,493 B1 10/2005 Lu
7,018,257 B2 3/2006 Courtney
7,178,547 B2 2/2007 Mackal
7,267,509 B1 * 9/2007 Jackson, III ..... 405/186
7,682,209 B2 * 3/2010 Huang ..... 441/93
2003/0068939 A1 4/2003 Ishihara
2004/0033740 A1 2/2004 Jones
2004/0157514 A1 8/2004 Courtney
2005/0101203 A1 5/2005 Kemp
2005/0221700 A1 10/2005 Weinel
2006/0270290 A1 11/2006 Tellew

* cited by examiner

PERSONAL WATER SAFETY DEVICE

CROSS-REFERENCE TO RELATED APPLICATIONS

This application claims the benefit of and priority to U.S. Provisional Patent Application Ser. No. 61/003,637, filed Nov. 19, 2007, the entire contents of which are incorporated by reference herein.

BACKGROUND

1. Technical Field

This application relates to a water safety device, and more particularly, to a compact selectively inflatable device for use during water activities.

2. Background of Related Art

Shore and near shore activities have always been popular, especially in warmer climates and during summer months. Persons of all ages and aquatic capabilities engage in a variety of pastimes including swimming, surfing, snorkeling, kayaking, boogie-boarding, life guarding, etc. In performing these activities, people tend to rely on life jackets, buoys, kickboards, etc. Many of these activities are more suitably performed when unencumbered by bulky clothing or other prohibitive article that requires one to sacrifice maneuverability.

Although certain activities, extreme surfing for example, can produce greater risk, any activity performed in water has the potential for personal injury or even death. Therefore, a continued need to rely on water safety devices exits. Accordingly, safety devices have been known for some time and are produced in a number of forms. One style, perfected for Navy Fliers during World War II, and referred to as a Mae West, applied an expanding gas to inflate a bladder to provide buoyancy. This approach has since been adapted to sporting use, particularly for off-shore sailing. However, in this application, the water safety device is worn as a vest. Although highly effective as a water safety device, the vest tends to encumber free movement, which is, unfortunately, a large deterrent for those who are engaged in near shore activities. Thus, for those who fail to use a safety device or who use an inadequate device during the engagement of such activities, the potential risk for harm is heightened. As such, a small, easily worn device that does not encumber the user, but can provide significant flotation under necessary circumstances, would be of great benefit.

SUMMARY

The present invention relates to a compact water safety device having a strap and a housing attached thereto. The strap is configured and dimensioned to detachably mount to a plurality of different sized upper arms and includes a cinch and a fastening device. The housing includes an inflatable bladder, an inflation assembly, and an actuator. The housing is configured and dimensioned to accommodate the inflatable bladder in an uninflated configuration.

The actuator includes a lanyard having a ring disposed at the proximal end thereof and the inflation assembly disposed at the distal end thereof. The ring and the lanyard are configured and dimensioned to be selectively actuable to a predetermined tension sufficient to cause the inflation assembly to inflate the inflatable bladder. Furthermore, the actuator is configured and dimensioned to selectively actuate the inflation assembly to cause the inflatable bladder to inflate to a volume that is sufficient to enable different sized users to remain afloat upon inflation thereof.

After inflation, the inflatable bladder remains attached in a substantially stationary position adjacent to the upper arm of the user by the strap both before and after inflation. In one embodiment, the inflatable bladder is formed in a substantially cylindrical shape when inflated. A second strap may be attached to the inflatable bladder, whereby the second strap provides additional stability for the user when the inflatable bladder is inflated. At least one of the inflatable bladder, the strap, and the second strap can be formed of a high visibility material:

The inflation assembly includes a gas container disposed in a frame, whereby the gas container provides gas to the inflatable bladder upon actuation. Furthermore, the gas container is disposed within the inflatable bladder, wherein the inflatable bladder is disposed in a folded configuration and at least partially disposed within the frame.

The frame includes a cam rotatably connected thereto by a cam pin, wherein the cam is attached to the actuator and configured and dimensioned to cause the gas container to deploy gas. The frame further includes an attachment aperture configured and dimensioned to receive either the at least one strap or a portion of the housing. The frame also includes a retaining clip, whereby the retaining clip prevents at least one of the gas container and a portion of the inflatable bladder from dislodging from the frame. The retaining clip is disposed in a pair of recesses, wherein each recess is disposed on an opposing side of the frame and includes a ramp. The cam is configured and dimensioned to engage at least a portion of the retaining clip, whereby upon articulation of the cam, the retaining clip rises on at least one of the ramps to a predetermined articulation. As such, at least one end of the retaining clip is freed from at least one of the recesses. Thus, the inflatable bladder and the gas container are enabled to at least partially exit the frame. Since the cam is articulably attached to the retaining clip which is articulably attached to a portion of the housing. Upon selective articulation of the cam, the cam causes the retaining clip to articulate a portion of the housing into an open configuration, thereby enabling the inflatable bladder to exude from the housing.

The gas container includes a block assembly hermetically connected to the gas container. The gas container further includes a diaphragm disposed on one end. The block assembly has a ball and a pin at least partially translatably disposed therein, wherein the ball is attached to the pin, and wherein the cam is configured and dimensioned to engage the ball upon a predetermined articulation of the cam. A predetermined articulation causes the ball to drive the pin into the diaphragm, wherein the diaphragm is configured and dimensioned to break upon a predetermined engagement force from the pin. The block assembly further comprises at least one vent, whereby the at least one vent provides a conduit for the gas to flow from the gas container to the inflatable bladder. The pin includes an axial cut portion, wherein the axial cut portion is cut to an angle sufficient to facilitate the venting of gas into the at least one vent. Upon the breaking of the diaphragm, the gas is deployed from the gas container, through the at least one vent, and into the inflatable bladder. The gas container is detachably connected to the frame so that after use, a new gas container can be inserted in the frame, enabling the inflatable bladder to be reinflated.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF EMBODIMENTS

Figure 1:
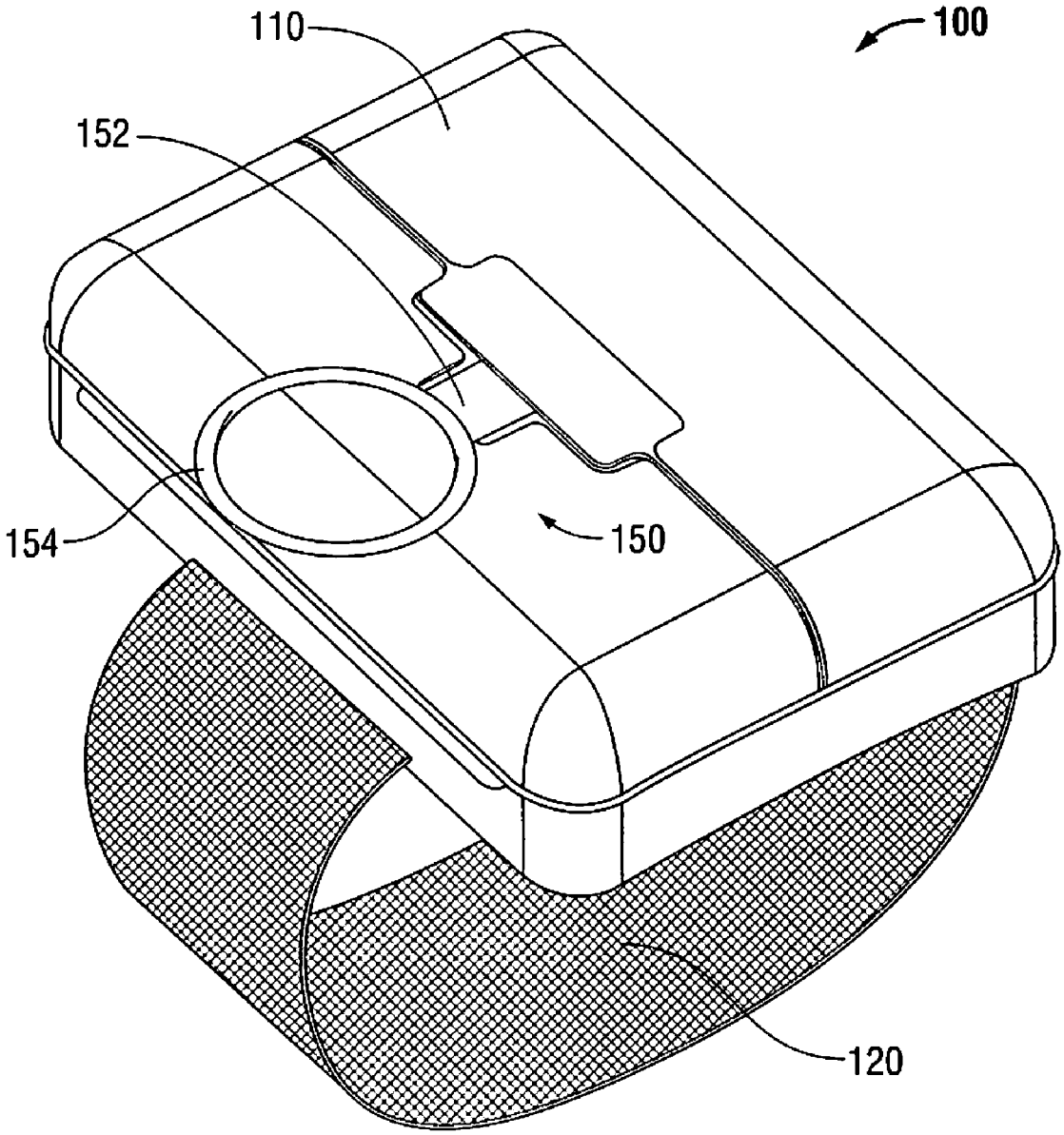
FIG. 1 is a front perspective view of one embodiment of a personal water safety device in accordance with the present disclosure.

Particular embodiments of the present disclosure will be described herein with reference to the accompanying drawings. As shown in the drawings and as described throughout the following description, and as is traditional when referring to relative positioning on an object, the term "proximal" refers to the end of the device that is closer to the user and the term "distal" refers to the end of the device that is further from the user. In the following description, well-known functions or constructions are not described in detail to avoid obscuring the present disclosure in unnecessary detail.

Figure 2:
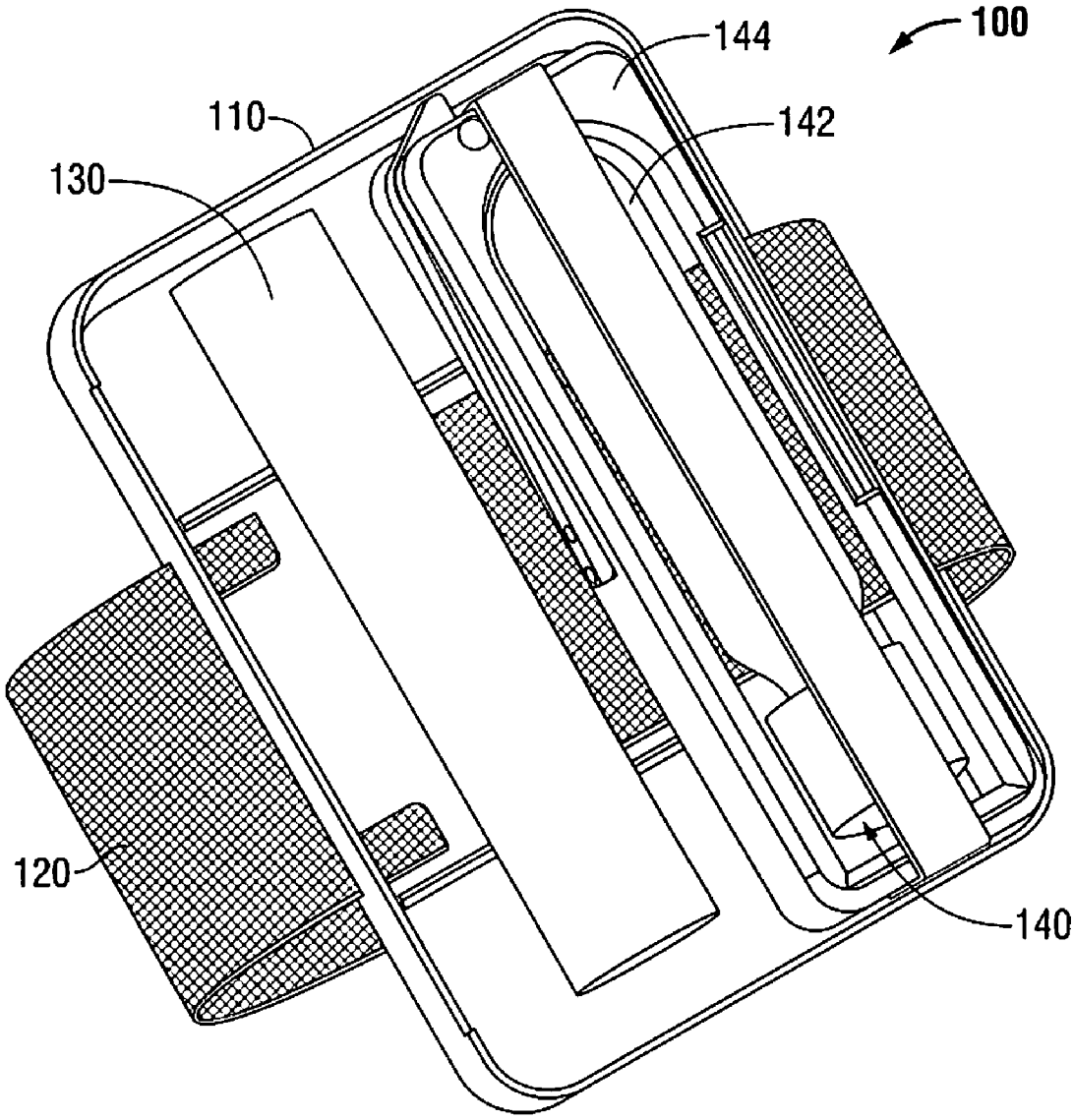
FIG. 2 is a front perspective view of the personal water safety device of FIG. 1 with a portion of the housing removed for clarity.
Figure 9:
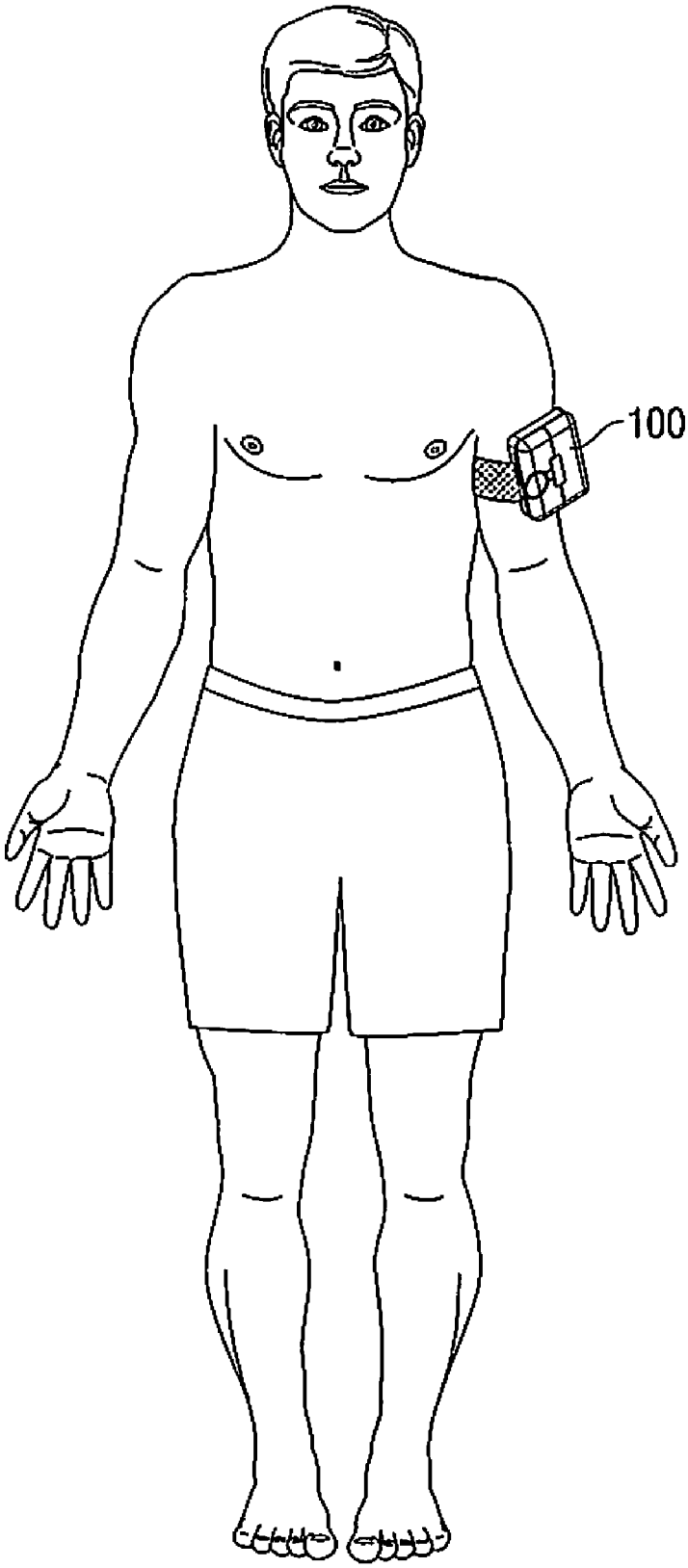
FIG. 9 is a front perspective view of a personal water safety device in an uninflated configuration, the personal water safety device attached to a user's upper arm in accordance with the present disclosure.

Referring now to the drawings, in which like reference numerals identify identical or substantially similar parts throughout the several views, FIGS. 1 and 2 illustrate a personal water safety device 100. In accordance with the present disclosure, the personal water safety device 100 includes a housing 110 and a strap 120 attached thereto. The strap 120 is configured and dimensioned to detachably mount to a plurality of different sized upper arms of an individual (FIG. 9). The housing 110 includes an inflatable bladder 130, an inflation assembly 140 and an actuator 150. The housing 110 is configured and dimensioned to accommodate the inflatable bladder 130 in an uninflated configuration. The uninflated configuration is designed to be relatively small enough not to impede aquatic activities and to securely fit on a user's arm.

Figure 3:
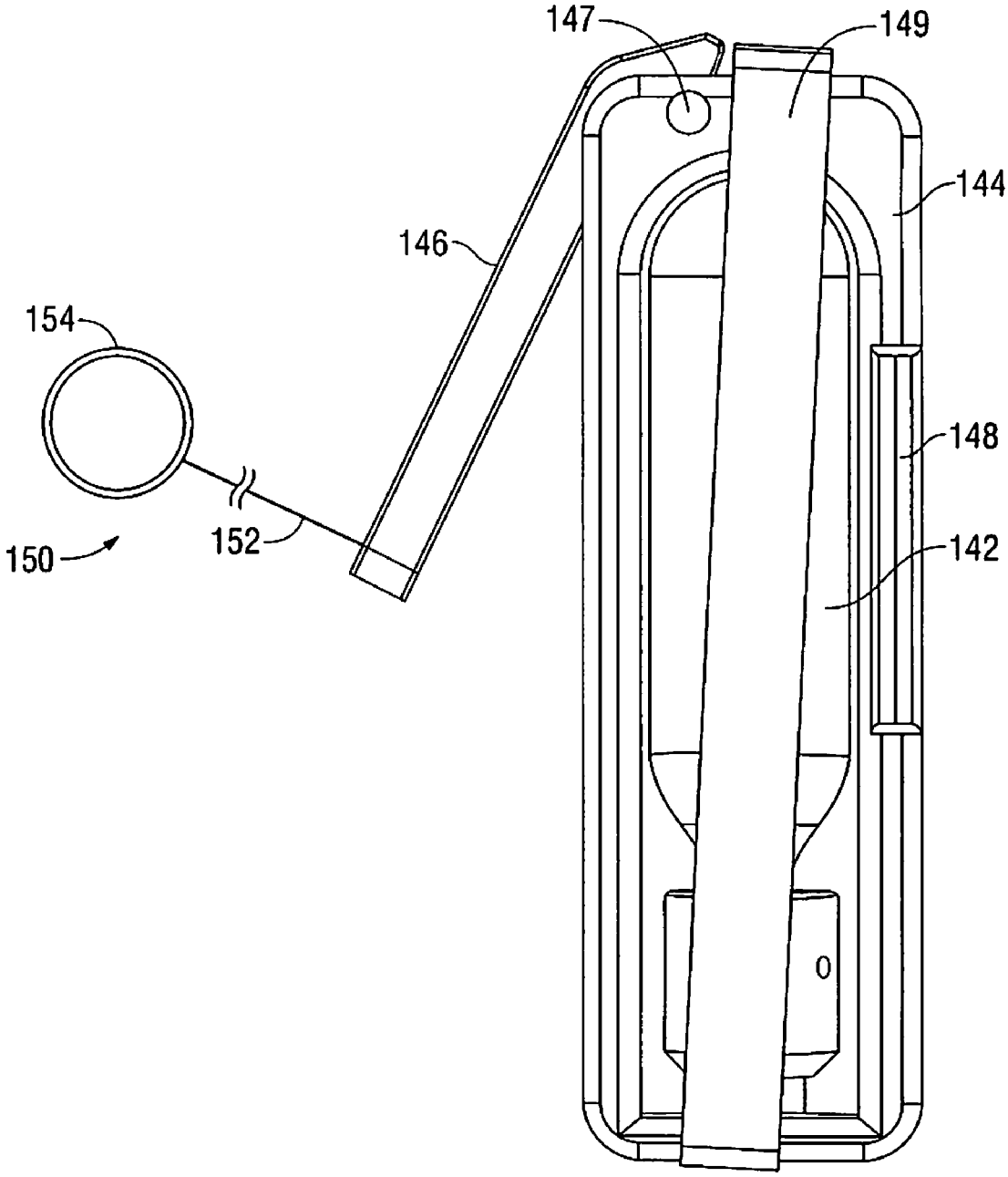
FIG. 3 is a top plan view of an inflation assembly of the personal water safety device of FIGS. 1 and 2, the inflation assembly including the cam partially articulated and having a retaining clip and an actuator disposed thereon.

Referring now to FIGS. 1 and 3, the actuator 150 includes a lanyard 152 having a ring 154 disposed at the proximal end thereof. The inflation assembly 140 is disposed at the distal end of the lanyard 152. The ring 154 and the lanyard 152 are configured and dimensioned to be selectively actuable to a predetermined tension sufficient to cause the inflation assembly 140 to inflate the inflatable bladder 130. Furthermore, the actuator 150 is configured and dimensioned to selectively actuate the inflation assembly 140 to cause the inflatable bladder 130 to inflate to a volume that is sufficient to enable a plurality of different sized users to remain afloat upon inflation thereof.

With additional reference to FIG. 2, the inflation assembly 140, which is fastened to the inflatable bladder 130 and disposed in the interior of the inflatable bladder 130 upon inflation, includes a gas container 142 disposed in a frame 144. The gas container 142 remains hermetically sealed within the inflatable bladder 130 before and after the inflatable bladder 130 is inflated. The gas container 142 provides gas (e.g., $CO_2$) to the inflatable bladder 130 upon gas deployment therefrom. In other words, when the inflation assembly 140 is actuated, the liquid $CO_2$ is allowed to evaporate and expand so as to fill the inflatable bladder 130 with gas to its extents. The inflatable bladder 130 is shown in an uninflated, folded configuration with a portion disposed in the inflation assembly removed for clarity. However, it is envisioned that the gas container 142 is disposed within the inflatable bladder 130, wherein the inflatable bladder 130 is disposed in a folded configuration and at least partially disposed within the frame 144. The inflatable bladder 130 is securely affixed to the housing 110 and strap 120 by way of adhesives, fasteners, welding, or the like.

Referring again to FIG. 3, the frame 144 includes a cam 146 rotatably connected thereto by a cam pin 147, wherein the cam 146 is attached to the actuator 150 and configured and dimensioned to cause the gas container 142 to deploy gas. The frame 144 further includes an attachment aperture 148 configured and dimensioned to receive either a portion of the strap 120 or a portion of the housing 110. The attachment aperture 148 is attached (by e.g., welding) to either the strap 120 or the housing 110. The frame 144 also includes a retaining clip 149, whereby the retaining clip 149 prevents at least one of the gas container 142 and a portion of the inflatable bladder 130 from prematurely dislodging from the frame 144.

Figure 4:
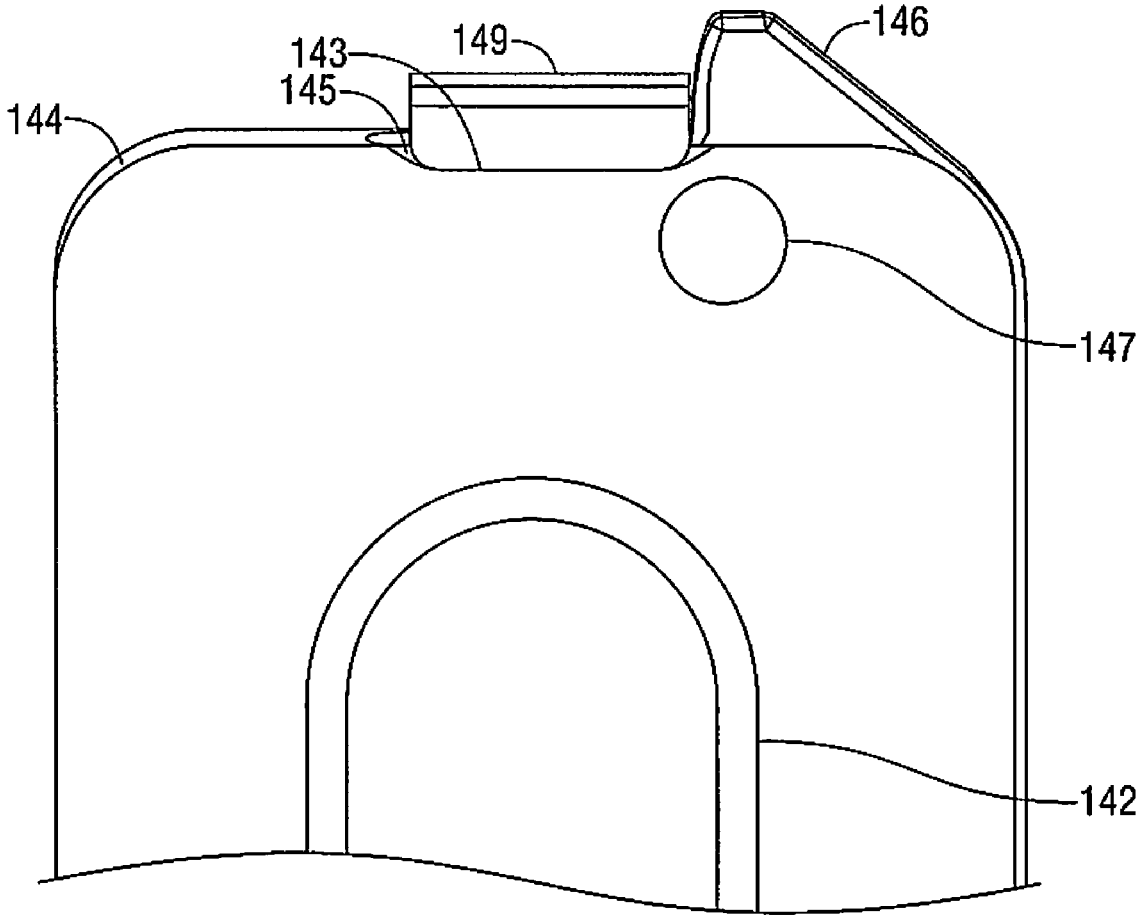
FIG. 4 is an enlarged rear perspective view of a portion of the inflation assembly of FIG. 3.

As seen in FIG. 4, the retaining clip 149 is disposed in a pair of recesses 143*a*, 143*b* wherein each recess 143 is disposed on an opposing side of the frame 144 and includes a ramp 145. The cam 146 is configured and dimensioned to engage at least a portion of the retaining clip 149, whereby upon articulation of the cam 146, the retaining clip 149 rises on the at least one of the ramps 145*a*, 145*b* to a predetermined articulation. As such, at least one end of the retaining clip 149 is freed from at least one of the recesses 143*a*, 143*b*. Thus, the inflatable bladder 130 and the gas container 142 are enabled to at least partially exit the frame 144. The cam 146 is articulably attached to the retaining clip 149 and the retaining clip 149 is articulably attached to a portion of the housing 110. Therefore, upon selective articulation of the cam 146, the cam 146 causes the retaining clip 149 to articulate a portion of the housing 110 into an open configuration, thereby enabling the inflatable bladder 130 to exude from the housing 110.

Figure 5:
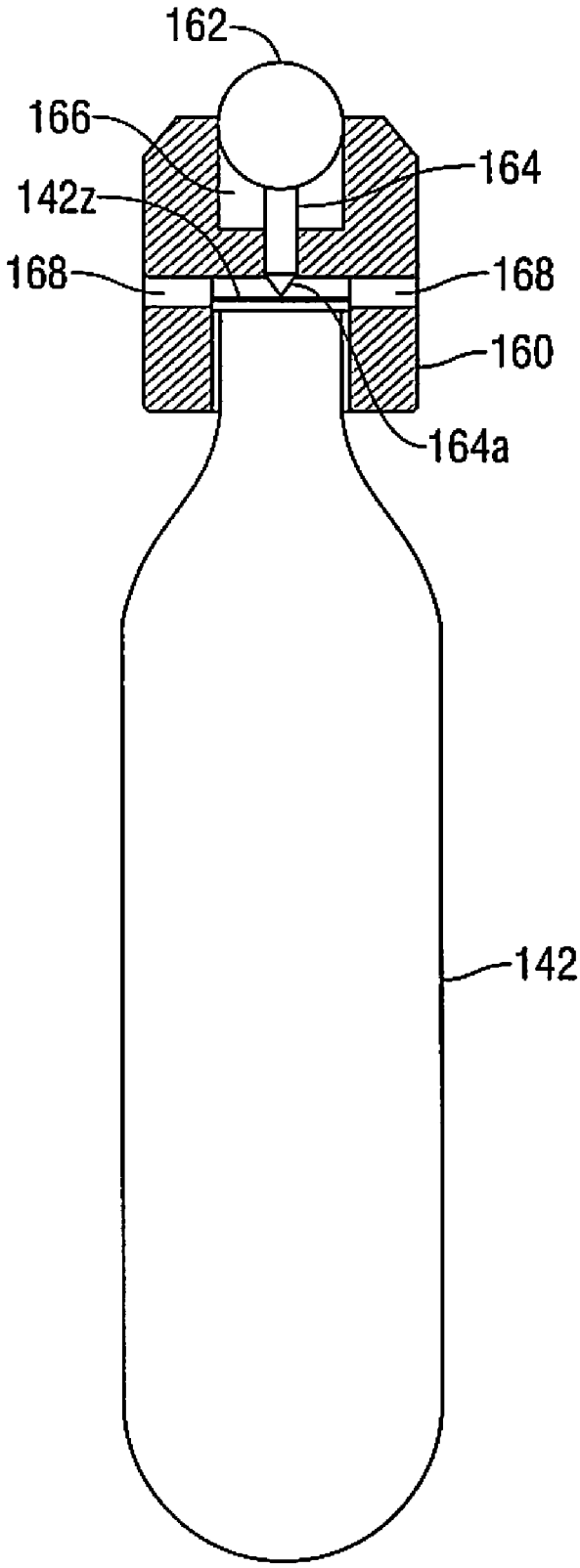
FIG. 5 is a cross-sectional view of the gas container and block assembly of the inflation assembly of FIGS. 3-4.

Referring now to FIG. 5, the gas container 142 comprises a block assembly 160 hermetically connected to the gas container 142 (e.g., by a threaded connection, bayonet connection, snap-on connection, etc.). The gas container 142 further includes a diaphragm 142*z* disposed on one end. The diaphragm 142*z* is configured and dimensioned to seal gas inside the gas container 142 until the diaphragm 142*z* is broken, pierced, or otherwise impinged.

The block assembly 160 has a ball 162 and a pin 164 at least partially translatably disposed in a bore 166 therein. The ball 162 is attached to proximal end of the pin 164. The ball is configured to provide the instant compressive load to the pin 164. The pin 164 has a sharp distal point for puncturing the diaphragm 142*z*. The cam 146 is configured and dimensioned to engage the ball 162 upon a predetermined articulation of the cam 146. A predetermined articulation of the cam 146 causes the ball 162 to drive the distal end of the pin 164 into the diaphragm 142*z*, wherein the diaphragm 142*z* is configured and dimensioned to break upon a predetermined engagement force from the distal end of the pin 164. The block assembly 160 further comprises a vent 168 cut through a portion of the bore 166. As such, the vent 168 provides a conduit for the gas to flow from the gas container 142 to the inflatable bladder 130. The pin 164 includes an axial cut portion 164*a*, wherein the axial cut portion 164*a* is cut to an angle sufficient to facilitate the venting of gas into the vent 168. Upon the breaking of the diaphragm 142*z*, the gas is deployed from the gas container 142, through the vent 168 and into the inflatable bladder 130. The gas container 142 is detachably connected to the frame 144 so that after use, a new gas container 142 can be inserted in the frame 144, enabling the inflatable bladder 130 to be reinflated.

Figure 6:
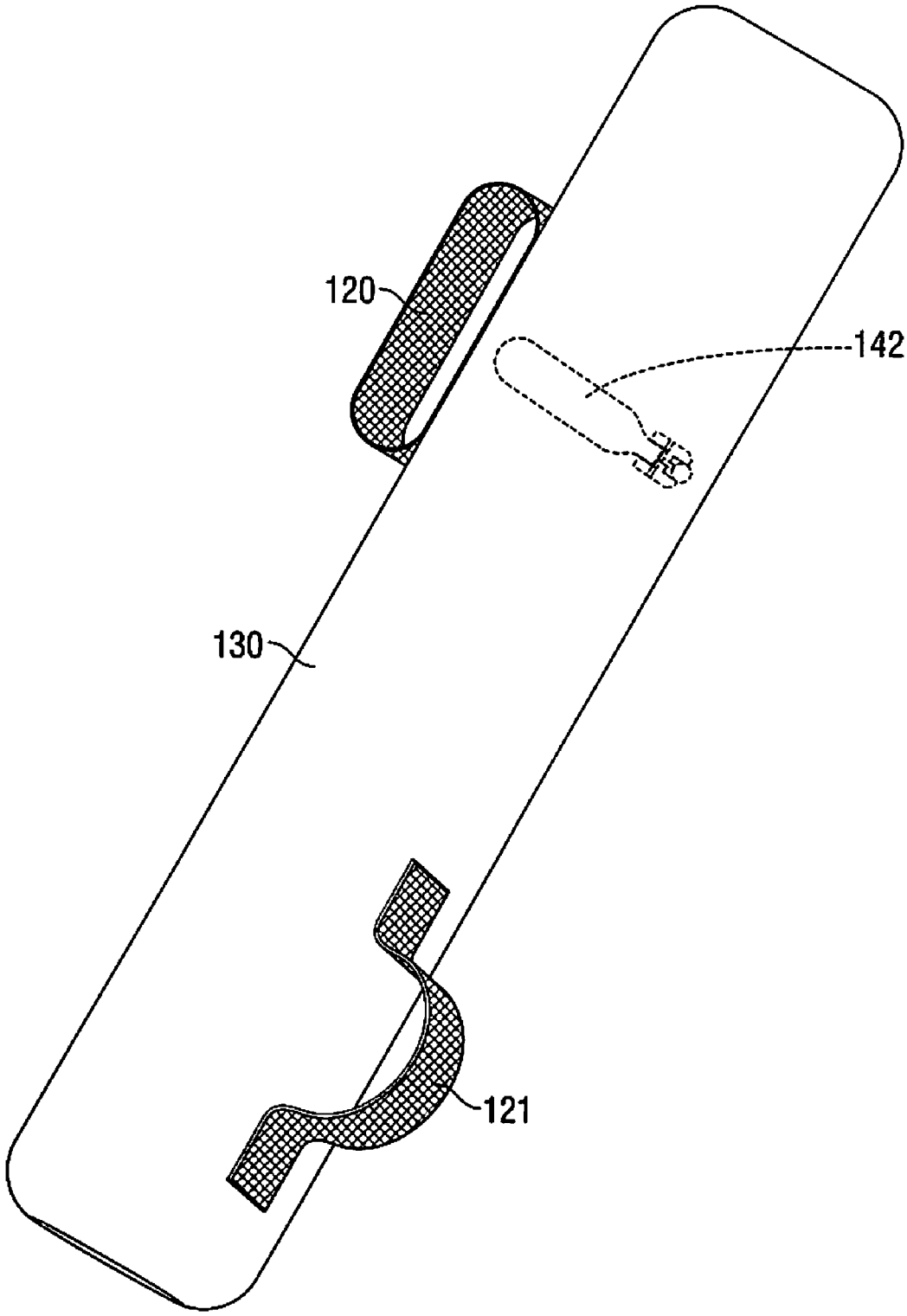
FIG. 6 is a perspective view of the inflated bladder of the personal water safety device of FIGS. 1-2.
Figure 10:
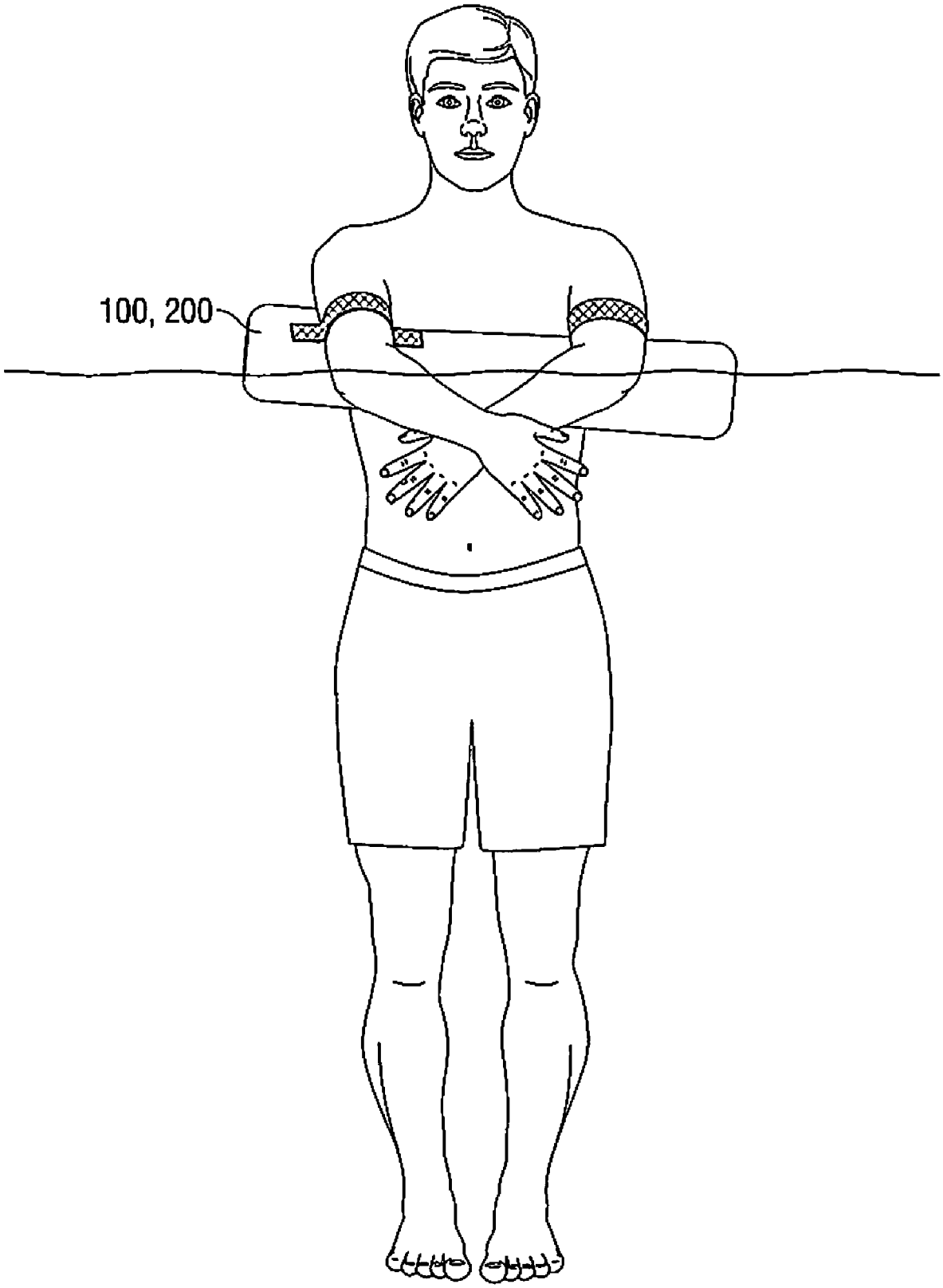
FIG. 10 is a front perspective view of a personal water safety device in an inflated configuration, the personal water safety device attached to a user's upper arm as the user remains afloat in water in accordance with the present disclosure.

Referring now to FIGS. 6 and 10, the inflatable bladder 130 remains fixedly attached to the upper arm of the user by the strap 120 after inflation. The inflatable bladder is disposed in a substantially cylindrical shape configured to assist a user, either conscious or unconscious, to keep afloat with the user's airway above the water surface when in or on water. Other shapes and configuration are also contemplated herein including, but not limited to, spherical, toroidal, etc. A second strap 121 is attached to the inflatable bladder 130, whereby the second strap 121 provides additional stability for the user when the inflatable bladder 130 is disposed in an inflated configuration. At least one of the inflatable bladder 130, the strap 120, and the second strap 121 can be formed of a high visibility material.

Figure 7:
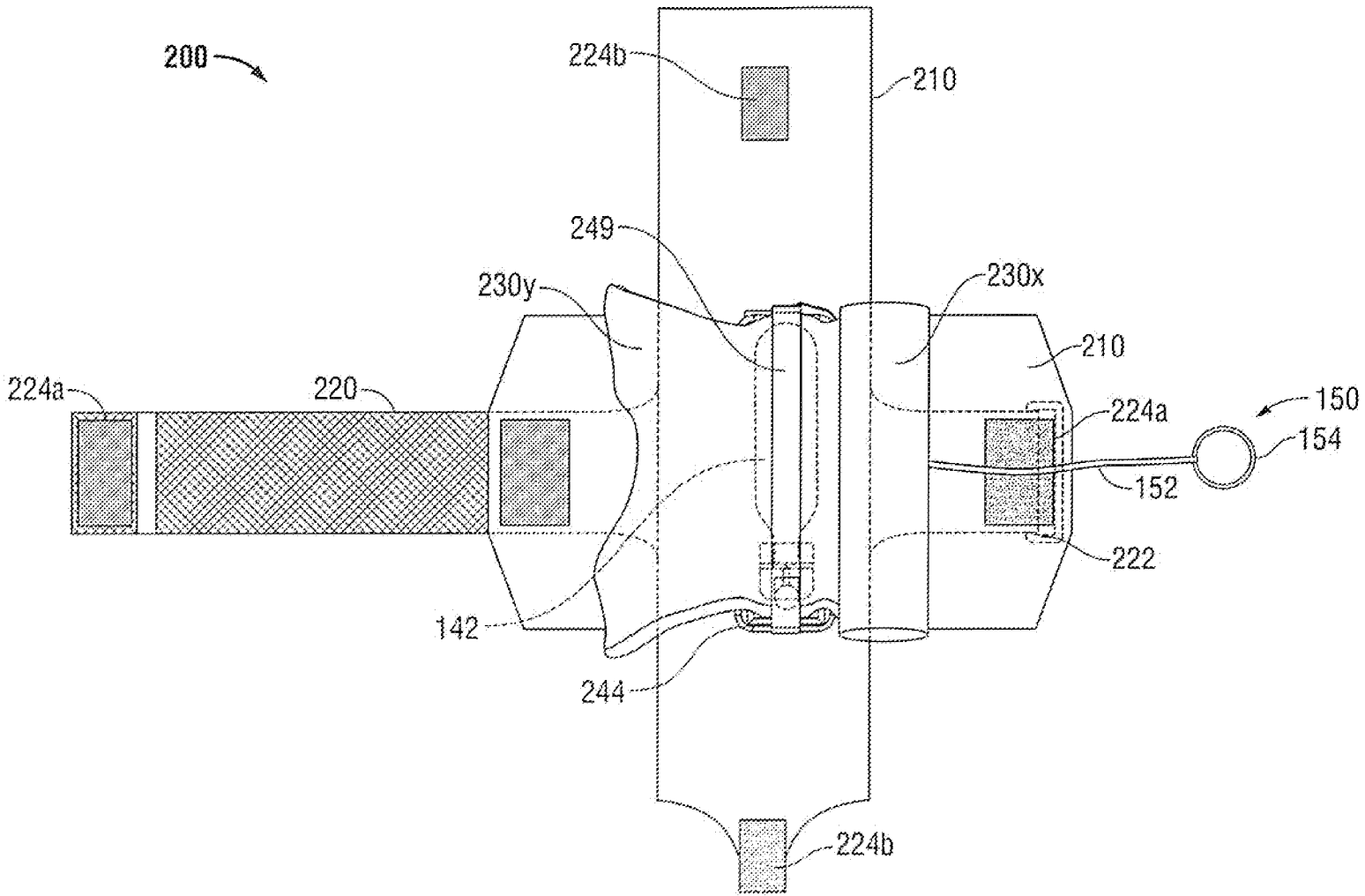
FIG. 7 is a top plan view of another embodiment of the personal water safety device in a partially assembly configuration in accordance with the present disclosure.
Figure 8:
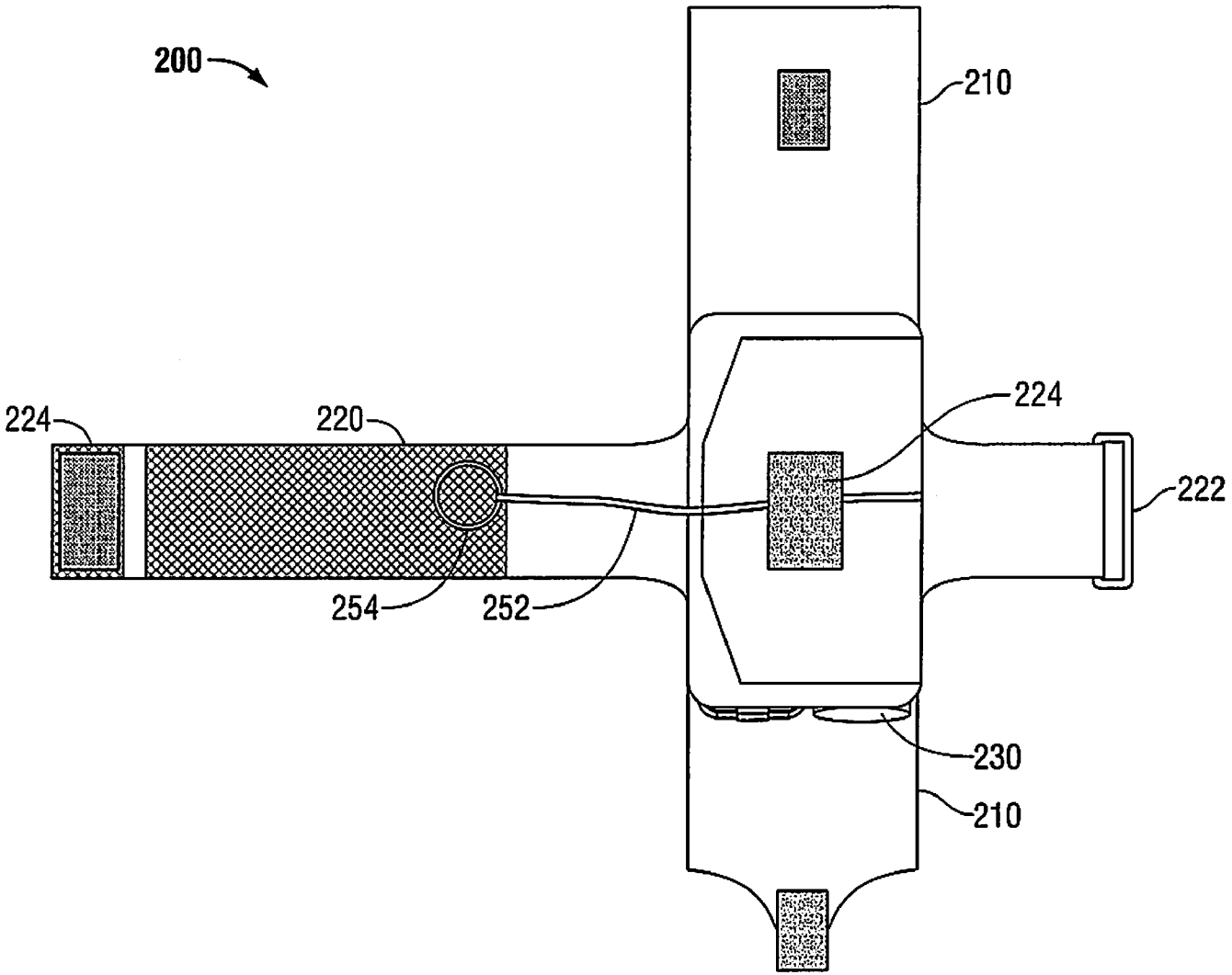
FIG. 8 is a top plan view of the personal water safety device of FIG. 7 in a further partially assembly configuration.

In another embodiment of the personal water safety device 200, as illustrated in FIGS. 7 and 8, the strap 220 includes a cinch 222 to tighten the strap 220 to the upper arm of an individual. The strap 220 also includes a fastening device 224 attached thereto, enabling the user to fasten the strap 220 to the upper arm. In this embodiment, both the housing 210 and the strap 220 include a fastening device 224*a*, 224*b*, which manifests itself as a hook and loop-type fastener 224, such as VELCRO. Namely, a synthetic material sold in ribbon, sheet, or piece goods form. The material has complementary parts which adhere to each other when pressed together and are adapted for use as a closure fastener, or button for closing garments, curtains, or the like. In addition, this also includes separable fasteners and components thereof.

As shown in FIG. 7, the housing 210 holds the inflatable bladder 130 in a folded configuration having a first portion 230*x* disposed in a rolled orientation and a second portion 230*y* partially disposed in the frame 244 and held by the retaining clip 249. From FIG. 8, a portion of the housing 210 is folded over the inflatable bladder 230, the inflation assembly 140, and a portion of the actuator 150. In this embodiment, the lanyard 252 is partially situated to tear the bond from the fastening device 224 (i.e., the hook and loop-type fastener) between the folded over portions of the housing 210 so that upon actuation of the lanyard 252, the folded over portions of the housing 210 are unfolded, freeing the inflatable bladder 230 to exude from the housing 210. In addition, the lanyard 252 actuates the inflation assembly 240 to cause gas to inflate the inflatable bladder 230.

In operation, when requiring additional buoyancy, the user simply pulls the ring 154, 254 and tensions the lanyard 152, 252 with enough force to activate the cam 146, 246. The tensioning of the lanyard 152, 252 has the further effect of tearing open a portion of the housing 110, 210 so that the inflatable bladder 130, 230 is free to expand. The cam 146, 246 then causes the pin 164, 264 to puncture the diaphragm 142*z*, 242*z* and the retaining clip 144, 244 to release the inflatable bladder 130, 230. The inflatable bladder 130, 230 inflates and remains attached in a substantially stationary position adjacent to the user's upper arm by the strap 120, 220 both before and after inflation thereof. In this orientation, the high visibility inflatable bladder 130, 230 can be used as a marker or flag to attract the attention of a potential rescuer. The second strap 121, 221, which is welded to the inflatable bladder 130, 230 provides stability to the user, enabling the user to insert the user's opposite arm.

The manufacture is simple and cost effective. The gas container 142, 242, frame 144, 244 and cam 146, 246 can be injection molded from a strong polymer such as polyamide or acetyl. The inflatable bladder 130, 230 and straps 120, 220, 121, 221 can be produced from a suitable film such as polyurethane. In particular, the inflatable bladder 130, 230 can be formed of a high visibility film produced in orange, red, yellow, blue, green or the like. The housing 110, 210 can be formed of a similar film, or can be injection molded from a suitable and compliant polymer such as polyurethane. The welding procedures can be thermal, ultra sonic, radio frequency or the like. It is envisioned that the personal water safety device 100, 200 can be designed to support individuals weighing up to 250 lbs. In addition, even more compact models can be designed to support children and adults under 150 lbs.

Additional embodiments are also contemplated, including the addition of further functionality such as a whistle, horn, or other noise maker. A strobe or light can be included for night and limited visibility conditions. Further, an emergency position indicating Radio Beacon (EPIRB) or the like (e.g., GPS) can be provided.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of preferred embodiments. Thus the scope of the embodiments should be determined by the appended claims and their legal equivalents, rather than by the examples given.

What is claimed is:

1. A personal water safety device comprising:

at least one strap detachably mountable to an upper arm portion of a user; and a housing attached to the at least one strap, the housing enclosing an inflatable bladder, an actuator, and an inflation assembly disposed completely within the inflatable bladder wherein selective actuation of the actuator causes the inflatable bladder to inflate, the inflation assembly including a gas container that provides gas to the inflatable bladder upon deployment of gas from the gas container, the gas container is disposed in a frame; and wherein the inflatable bladder remains attached in a substantially stationary position adjacent the user's upper arm by the at least one strap both before and after inflation; and wherein a cam is rotatably connected to the frame by a cam pin, wherein rotation of the cam with respect to the frame causes the gas container to deploy gas.

2. A personal water safety device according to claim 1, wherein the housing accommodates the inflatable bladder in an uninflated configuration.

3. A personal water safety device according to claim 1, wherein the at least one strap further comprises at least one cinch.

4. A personal water safety device according to claim 1, further comprising at least one fastening device attached to at least one of the housing or the at least one strap.

5. A personal water safety device according to claim 4, wherein the at least one fastening device includes a hook and loop-type fastener.

6. A personal water safety device according to claim 1, wherein the actuator includes a lanyard having a ring disposed at the proximal end thereof and the inflation assembly disposed at the distal end thereof, wherein the ring and the lanyard are selectively actuable to a predetermined tension sufficient to cause the inflation assembly to inflate the inflatable bladder.

7. A personal water safety device according to claim 1, further comprising a second strap attached to the inflatable bladder.

8. A personal water safety device according to claim 1, further comprising a retaining clip removably connected to the frame that prevents at least one of the gas container and a portion of the inflatable bladder from prematurely dislodging from the frame.

9. A personal water safety device according to claim 8, wherein the cam is movably attached to the retaining clip and the retaining clip is movably attached to a portion of the housing whereby selective movement of the cam causes the retaining clip to move a portion of the housing into an open configuration, thus enabling the inflatable bladder to extend from the housing.

10. A personal water safety device according to claim 9, wherein the retaining clip is disposed in a pair of recesses and each recess is disposed on an opposing side of the frame.

11. A personal water safety device according to claim 10, wherein at least one of the recesses includes a ramp, and wherein the cam engages at least a portion of the retaining clip such that upon movement of the cam, the retaining clip rises on the at least one ramp to a predetermined position, whereby at least one end of the retaining clip is freed from at least one of the recesses, and whereby the inflatable bladder and the gas container are enabled to at least partially extend from the frame.

12. A personal water safety device according to claim 1, wherein the gas container is detachably connected to the frame.

13. A personal water safety device according to claim 1, wherein the personal water safety device is reusable, whereby the inflatable bladder is both deflatable and subsequently reinflatable after inflation.

14. A personal water safety device comprising:

at least one strap detachably mountable to an upper arm portion of a user; and a housing attached to the at least one strap, the housing enclosing an inflatable bladder, an actuator, and an inflation assembly disposed completely within the inflatable bladder wherein selective actuation of the actuator causes the inflatable bladder to inflate, the inflation assembly including a gas container that provides gas to the inflatable bladder upon deployment of gas from the gas container, the gas container is disposed in a frame and includes a block assembly, the block assembly being hermetically sealed, wherein the gas container includes a diaphragm disposed on one end, wherein the block assembly has a ball and a pin at least partially movably disposed therein, and wherein the cam engages the ball upon a predetermined positioning of the cam, whereby predetermined movement of the cam causes the ball to drive the pin into the diaphragm, wherein the diaphragm breaks upon a predetermined force from the pin, whereby upon the breaking of the diaphragm, the gas is deployed into the inflatable bladder; and wherein the inflatable bladder remains attached in a substantially stationary position adjacent the user's upper arm by the at least one strap both before and after inflation.

15. A personal water safety device according to claim 14, wherein the block assembly further comprises at least one vent that provides a conduit for the gas to flow from the gas container to the inflatable bladder.

16. A personal water safety device according to claim 14, further comprising a retaining clip removably connected to the frame that prevents at least one of the gas container and a portion of the inflatable bladder from prematurely dislodging from the frame.

17. A personal water safety device comprising:

at least one strap detachably mountable to an upper arm portion of a user; and a housing attached to the at least one strap, the housing enclosing an inflatable bladder, an actuator, and an inflation assembly disposed completely within the inflatable bladder, the inflation assembly including a gas container disposed in a frame, the frame having a cam rotatably connected thereto by a cam pin, the rotation of the cam with respect to the frame causes the gas container to deploy gas, the gas container storing the gas therein prior to actuation of the actuator such that upon selective actuation of the actuator, the stored gas deploys from the gas container into the inflatable bladder such that the inflatable bladder inflates, the inflatable bladder remaining attached in a substantially stationary position adjacent the user's upper arm by the at least one strap both before and after inflation.

18. A personal water safety device according to claim 17, further comprising a retaining clip removably connected to the frame that prevents at least one of the gas container and a portion of the inflatable bladder from prematurely dislodging from the frame.

19. A personal water safety device according to claim 18, wherein the cam is movably attached to the retaining clip and the retaining clip is movably attached to a portion of the housing whereby selective movement of the cam causes the retaining clip to move a portion of the housing into an open configuration, thus enabling the inflatable bladder to extend from the housing.

20. A personal water safety device according to claim 1, wherein the inflation assembly remains completely within the bladder both before and after inflation.

* * * * *